US005730307A

United States Patent [19]

Karpisek

[11] Patent Number: 5,730,307

[45] Date of Patent: Mar. 24, 1998

[54] CONTAINER SIDE

[76] Inventor: Ladislav Stephan Karpisek, 86 Woodfield Boulevarde, Caringbah, New South Wales 2229, Australia

[21] Appl. No.: 696,851

[22] PCT Filed: Dec. 13, 1995

[86] PCT No.: PCT/AU95/00840

§ 371 Date: Jul. 31, 1996

§ 102(e) Date: Jul. 31, 1996

[87] PCT Pub. No.: WO96/18547

PCT Pub. Date: Jun. 20, 1996

[30] Foreign Application Priority Data

Dec. 14, 1994 [AU] Australia ..... PN0065

[51] Int. Cl.[6] ..... B65D 7/00

[52] U.S. Cl. ..... 220/6; 220/1.5; 220/334

[58] Field of Search ..... 220/1.5, 6, 7, 334

[56] References Cited

U.S. PATENT DOCUMENTS

| | | | |
|---|---|---|---|
| 3,729,111 | 4/1973 | Farnsworth . | |
| 3,941,271 | 3/1976 | Zargas et al. | 220/6 |
| 4,192,430 | 3/1980 | Cornou | 220/1.5 |
| 4,662,532 | 5/1987 | Anderson et al. | 220/1.5 X |
| 4,684,034 | 8/1987 | Ono et al. | 220/1.5 X |
| 4,715,508 | 12/1987 | Schurch | 220/1.5 X |
| 5,261,550 | 11/1993 | Karpisek | 220/1.5 X |
| 5,395,682 | 3/1995 | Holland et al. | 220/1.5 X |

FOREIGN PATENT DOCUMENTS

| | | |
|---|---|---|
| 2806667 | 4/1970 | Australia . |
| 3480089 | 11/1989 | Australia . |
| 2547436 | 4/1977 | Germany . |

*Primary Examiner*—Steven M. Pollard
*Attorney, Agent, or Firm*—Edwin D. Schindler

[57] ABSTRACT

A container side having an upper pan (6) and a lower part (7) hinged together by a hinge (19) so the upper part can pivot relative to the lower part. To substantially eliminate pressure loads on the hinge as are exerted by the load within the container of which the side is an element, load resisting means (12, 15) are provided to couple adjacent sides of the upper and lower parts. In a hinging sequence of the upper part (6) relative to the lower part (7) from a loading condition where the parts (6, 7) are overlying to an operational condition where they are coplanar, the load resisting means (12, 15) will automatically engage when the side parts (6, 7) approach the operational condition and will automatically disengage when the upper part (6) is hinged from the coplanar operational condition.

7 Claims, 3 Drawing Sheets

FIG. 3.
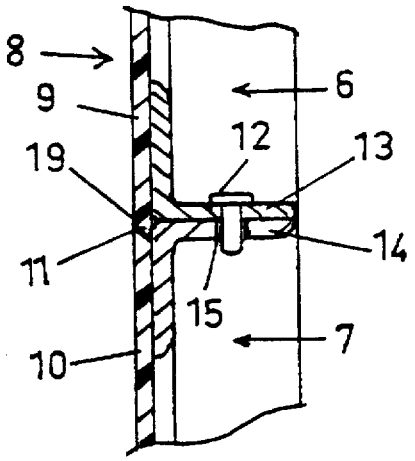
FIG. 4.
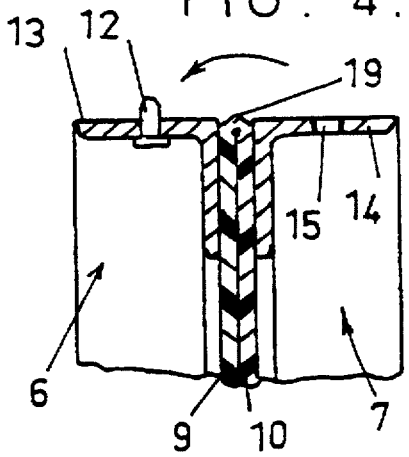
FIG. 5.
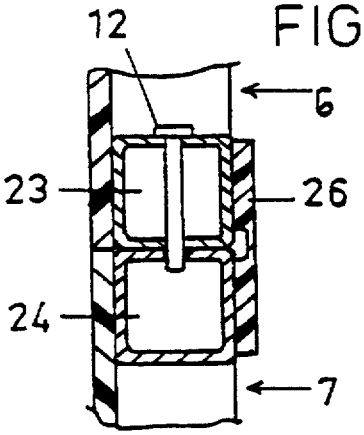
FIG. 6.
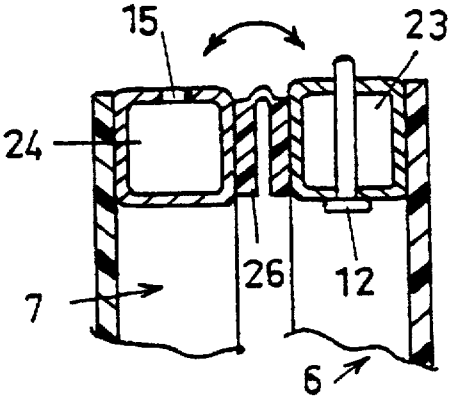
FIG. 7.
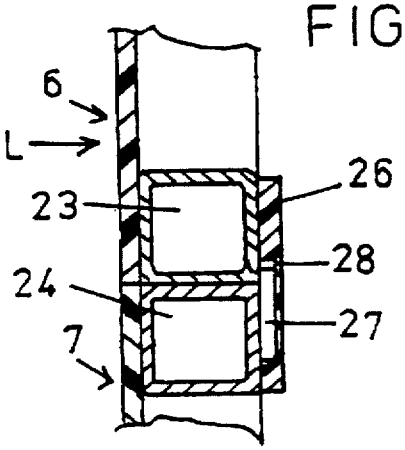
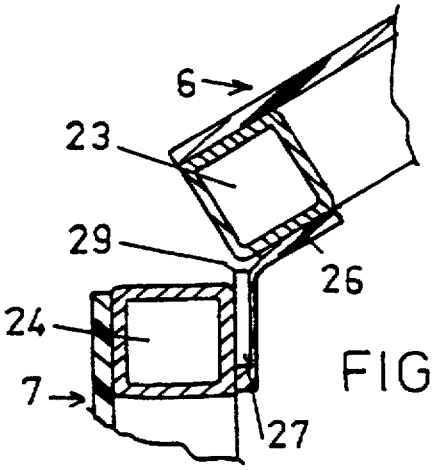
FIG. 8.

CONTAINER SIDE

FIELD OF THE INVENTION

This invention relates a side for a container, particularly a container which is used for the transport of liquids.

BACKGROUND TO THE INVENTION

It is common to provide containers comprised of a base and four interconnectable sides adapted to be demountably secured to the base, and a lid. Such containers are provided with a liner bag to hold liquid and discharge is through a nozzle on the bag which projects through one container side adjacent the container base.

In use the sides are mounted on the base and interlocked to provide a bag enclosure and the liner bag is placed in the enclosure and the nozzle is inserted into and passed through the nozzle hole in the container side from the inside of the enclosure. An operator finds it difficult to reach down into the container to insert the bag nozzle in the nozzle hole because the container sides are in the order of 1.2M high.

PRIOR ART

In the past one means of overcoming the above problem was the have the "nozzle side" of the enclosure laterally split to provide a lower part and an upper part. The upper part was connected by hinges to the lower part to allow the upper part to pivot outwardly. A major drawback with this arrangement was the bulkiness of the hinging arrangements which were used. The hinged part of the enclosure wall was held in place in the unfolded condition by bolts connecting the folding part to the adjacent enclosure walls.

OBJECTS OF THE INVENTION

The present invention has for its principal object the elimination of the bulky external hinge means of the prior art containers. A further object is to provide load resisting means at the hinge line between the upper and lower side parts to substantially eliminate pressure loads on the hinge connecting the upper and lower parts as are exerted by the load within a container of which the proposed container side forms part.

STATEMENT OF THE INVENTION

The invention can be said to provide a container side having an upper part and a lower part hinged together so the upper part can pivot relative to the lower part from a substantially co-planar operational condition to an overlying loading condition in which a liner bag can be readily loaded into a container of which the said side is an element, each container side part includes a frame covered with a liner panel and the liner panels provide a substantially continuous planar surface for the container side when said side parts are in the operational condition, load resisting means to couple adjacent sides of the frames of the upper and lower side parts where said load resisting means is automatically engaged when said side parts approach the operational condition following hinging of said upper part from the loading condition and which automatically disengages as said upper part is hinged from the operational condition towards the loading condition.

BRIEF DESCRIPTION OF THE DRAWINGS

Presently preferred embodiments of the invention will now be described with reference to the accompanying drawings in which;

FIG. 3 is an enlarged sectional view on the section line 3—3 of FIG. 1.

FIG. 4 is an enlarged sectional view on the section line 3—3 of FIG. 1 as it would appear when hinged as shown in FIG. 2.

FIG. 5 is a view similar to FIG. 3 of a second embodiment of the invention.

FIG. 6 is a view of the FIG. 5 components with the side parts hinging to a liner bag loading condition.

FIG. 7 is view similar to FIG. 5 showing an alternate form of load resisting means, and FIG. 8 is a view of the FIG. 7 components with the side parts hinging to a liner bag loading condition.

DETAILED DESCRIPTION OF THE DRAWINGS

Figure 2:
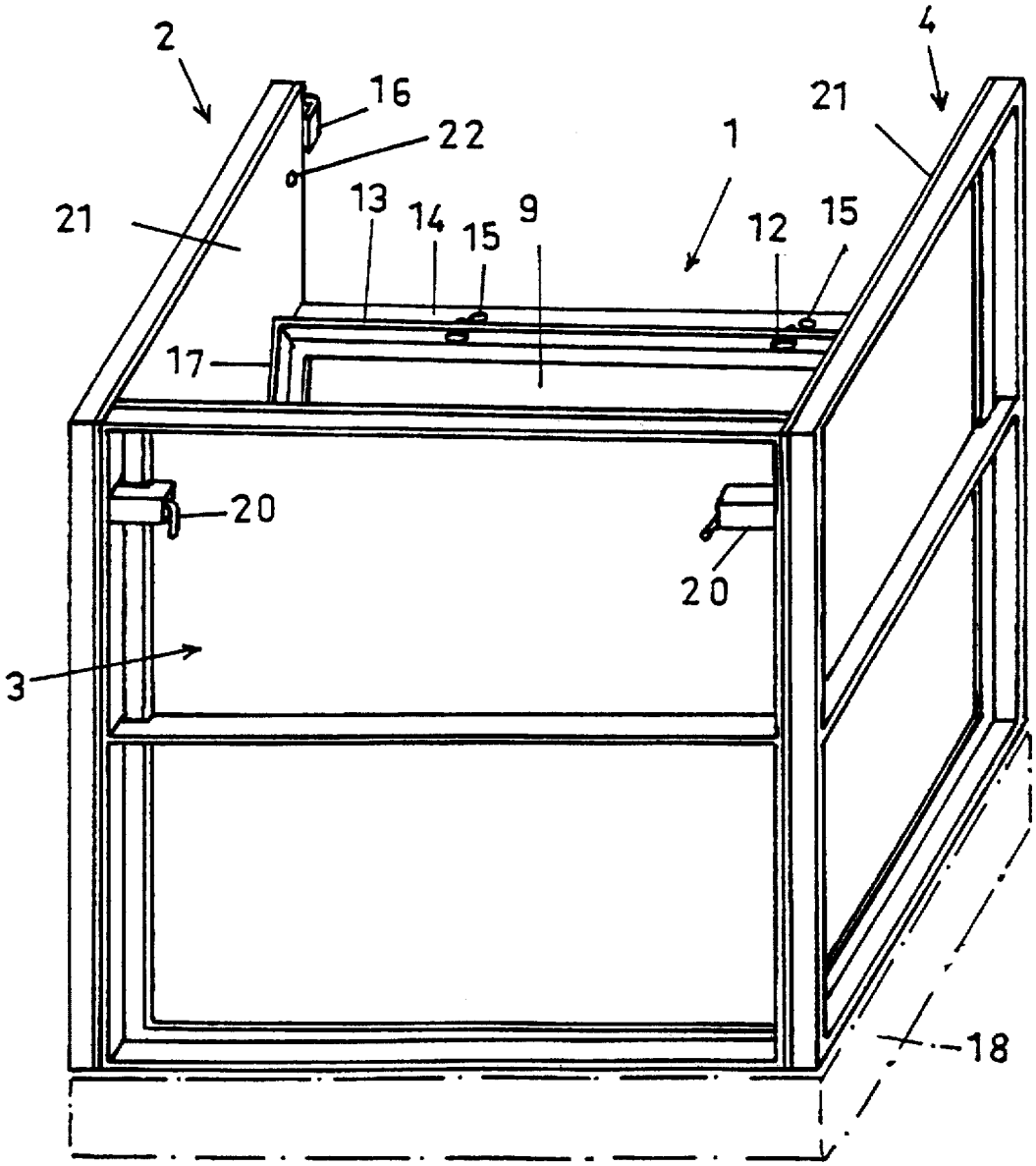
FIG. 2 is a perspective view of a container incorporating the nozzle side of FIG. 1 in an inwardly hinged liner bag loading condition.

A typical container which would include the nozzle side of the invention as illustrated in FIG. 2 would comprise four sides 1, 2, 3, 4 fixed permanently or demountably to the base 18. The container sides 2 3 and 4 all comprise angle steel frames covered with a smooth surfaced liner panel 21. The sides 2 to 4 are corner connected in any suitable releasable manner.

Figure 1:
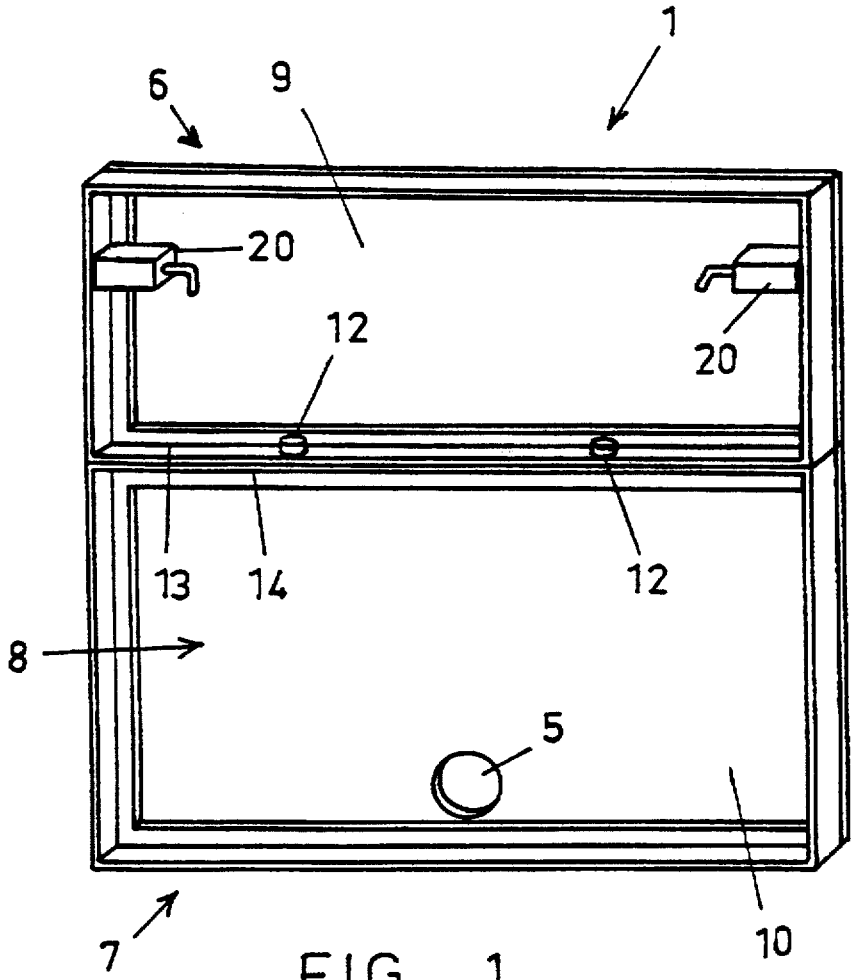
FIG. 1 is a perspective view of a first embodiment of a container nozzle side according to the invention.

The container nozzle side 1 shown in detail in FIG. 1 comprises an upper part 6 and a lower part 7. Each part 6 and 7 includes an angle steel frame and the parts 6 and 7 share a smooth surfaced liner sheet 8. The part 6 is releasably secured to the sides 2 and 4 and is intended to remain secured during use of the container.

The sheet 8 comprises two portions 9 and 10 with a Vee notch 11 (see FIG. 3) across the sheet 8 aligned with and facing the lower and upper frame members 13 and 14 of the side portions 6 and 7 respectively. The material 19 left as a result of the formation of the notch 11 acts as a hinge allowing the part 6 of the side 7 to hinge down inwardly relative to the side part 7. Securement means to be described releasably secures the side part 7 to the sides 2 and 4 when the side part 7 is in the upright operational position shown in FIG. 1.

The material from which the liner panel is made is such that it will withstand multiple flexures at the hinge 19 without fracture, high density polypropylene is a suitable material for this purpose.

The internal pressure when a liner bag in the container is filled with liquid could, in the absence of load resisting means, apply unacceptable loads on the hinge 19 of the sheet 8. In FIGS. 3 and 4 the load resisting means comprises pins 12 fixed to the bottom rail 13 of the part 6 of the side 1 and holes 15 in the upper rail 14 of the part 7 of the side 1. It is to be understood that the arrangement could be reversed with the pins in the rail member 14 and the holes in the member 13. In another arrangement pins and holes could be provided on both rail 13 and rail 14.

Location means is provided the prevent outward movement of the upper end of the part 6 of the side 1 beyond the upright condition shown in FIG. 1. The location means comprises hook lugs 16 spaced from the inner surface of the liner sheet 21 on the sides 2 and 4. The end members 17 of the frame of the part 6 are engaged by the hook lugs 16. The lugs limit the outward movement of the part 6 and at the same time prevent the spreading apart of the sides 2 and 4.

Latching means in the form of slide bolts identified 20 on the part 6 are engagable in holes 22 in the sides 2 and 4 to retain part 6 in the FIG. 1 condition.

In the second embodiment of the invention the part 6 of the side 1 is able to be hinged outwardly. This can be best seen in FIG. 5 where the portions 6 and 7 of the sheet 8 are separate members and are not hinged together as in the first embodiment. The angle shaped rails 13 and 14 are replaced by rectangular tubular members 23 and 24 and a strip of high density polypropylene or like performance material is fixed to the members 23 and 24 as illustrated and indicated 26 to act as a hinge. It is to be noted that in this arrangement the Vee form of the notch of FIGS. 3 and 4 has been varied to a groove of U form.

Load resisting means comprising pins and holes as used in the first embodiment can also be used in this embodiment, see FIGS. 5 and 6. Again, it is to be understood that the arrangement could be reversed with the pins 12 in the member 24 and the holes 15 in the member 23. In another arrangement pins and holes could be provided on both members 23 and 24.

FIGS. 7 and 8 illustrate an alternative load resisting means. As illustrated there is a load lug 27, which can be a single central broad lug or as an alternative two or three narrow lugs spaced along the length of the member 24, where the lug 27 extends above the top of the member 27. The lug 27 is accommodated in a very wide channel 28 in the hinge strip 26. As shown in FIG. 7, the part 29 of the lug 27 extending above the member 24 laterally supports the bar 23 against loads exerted in the direction of the arrow 'L' by the contents of the container of which the side 1 forms part. As shown in FIG. 8 hinging of the part 6 of the side 1 relative to the part 7 will automatically disengage the lug part 29 from the member 23.

Location means for the part 6 in this embodiment of the invention comprise lugs 25 on the part 6 which will bear on the outer end edges of the sides 2 and 4. The lugs 25 may include hooked ends to engage the outer faces of the sides 2 and 4 adjacent the side 1 thereby providing a restraint against the separation of the upper edges of the sides 2 and 4 adjacent the side 1.

Latching means in the form of slide bolts as used in the first embodiment would be suitable. As the static pressure exerted by the liquid in a liner bag in the container will be low at the upper end of the part 6 the slide bolt latching means will adequately resist the applied pressure. The static pressure exerted at the upper zones of the sides 1 to 4 will also be resisted by an appropriately designed lid which will embrace the upper edges of the sides 1 to 4 and is almost invariably used with liquid carrying containers of the present type.

I claim:

1. A container side adapted for mounting with other container sides on a base for providing a container, said container side comprising:

an upper part and a lower part in which each of said upper and lower parts includes a frame having two uprights joined by an upper rail and a lower rail with a spacing apart of the two uprights of the upper part and the lower part being the same;

a liner panel having a first surface and a second surface with said second surface overlying and fixed to inner sides of the frame of each the upper part and the lower part for linking said upper and lower parts, so that the upper and lower parts are co-planar with a coupling edge of the lower rail of the frame of the upper part and a coupling edge of the upper rail of the frame of the lower part of the container side will lie in substantially an abutting relationship, said liner panel having a thickness reducing lateral groove extending into said liner panel from the second surface of said liner panel and aligned with said coupling edge of the lower rail and said coupling edge of the upper rail for forming a hinge simulating flex zone, said liner panel being made of a material capable of undergoing repeated flexure at the hinge simulating a flex zone without failure, said flex zone allowing the upper part of said container side to hinge relative to said lower part of said container side for placing portions of said first surface of said liner panel at either side of said flex zone in an overlying relationship; and, coupling means for coupling together said coupling edge of said upper part and said coupling edge of said lower part when said upper part and said lower part are co-planar, said coupling means being disengaged and engaged automatically by hinging relative movement between said upper part and said lower part.

2. The container side according to claim 1, wherein said coupling means comprises at least one member projecting from said coupling edge of said upper part, and member receiving apertures in said coupling edge of said lower part.

3. The container side according to claim 1, wherein said coupling means comprises at least one member projecting from said coupling edge of said lower part, and member receiving apertures in said coupling edge of said upper part.

4. The container side according to claim 1, wherein said coupling means comprises fixed abutment means projecting above the coupling edge of said upper rail and positioned so that, when said upper part and said lower part are co-planar, an outer side of said lower rail abuts said fixed abutment means.

5. The container side according to claim 1, wherein said coupling means comprises fixed abutment means projecting above the coupling edge of said lower rail and positioned so that, when said upper part and said lower part are co-planar, an outer side of said upper rail abuts said fixed abutment means.

6. The container side according to claim 1, further comprising three additional container sides with a first container side of said additional container sides being disposed opposite said container side and joined at a first end and a second end, respectively, to first ends of a second and a third of said additional container sides, with second ends of said second and said third of said additional container sides joined respectively to said two uprights of said lower part of said container side, and location means at the second ends of said second and said third of said additional container sides at an elevation above said lower part of said container side for engagement by said two uprights of said upper part of said container side for limiting the hinging relative movement of said upper part of said container side beyond a co-planar relationship with said lower part of said container side.

7. The container side according to claim 6, wherein said two uprights of said upper part of said container side are engagable with hook elements on said location means for preventing a spreading apart of the second ends of said three additional container sides.

* * * * *